US007305924B2

(12) United States Patent
Steffl et al.

(10) Patent No.: US 7,305,924 B2
(45) Date of Patent: Dec. 11, 2007

(54) APPARATUS AND METHOD FOR DELIVERY OF BIOMASS FUEL

(75) Inventors: Charles J Steffl, Belview, MN (US); Joel W. McCoy, Granite Falls, MN (US)

(73) Assignee: Step Saver, Inc., Redwood Falls, MN (US)

( * ) Notice: Subject to any disclaimer, the term of this patent is extended or adjusted under 35 U.S.C. 154(b) by 0 days.

(21) Appl. No.: 10/960,323

(22) Filed: Oct. 7, 2004

(65) Prior Publication Data

US 2005/0126454 A1 Jun. 16, 2005

Related U.S. Application Data

(63) Continuation-in-part of application No. 10/835,620, filed on Apr. 28, 2004, now abandoned, which is a continuation of application No. 10/630,371, filed on Jul. 30, 2003, now abandoned.

(51) Int. Cl.
*F23B 7/00* (2006.01)
*F23J 1/00* (2006.01)

(52) U.S. Cl. ..... 110/341; 110/108; 110/259; 110/165 R; 110/341

(58) Field of Classification Search ..... 110/101 R, 110/101 CF, 104 R, 108, 259, 165 R, 166, 110/167, 168, 169, 170, 171, 165 A, 341; 134/21

See application file for complete search history.

(56) References Cited

U.S. PATENT DOCUMENTS 1,589,986 A * 6/1926 Russell ..... 134/21
3,580,420 A * 5/1971 Kennedy et al. ..... 222/1
4,002,372 A * 1/1977 Edwards et al. ..... 406/94
4,147,392 A 4/1979 Fuss
4,363,674 A * 12/1982 Fullenwider ..... 134/21
4,457,349 A * 7/1984 Vazin ..... 141/86
5,445,192 A 8/1995 Hansen

FOREIGN PATENT DOCUMENTS

DE 30 02 860 A1 7/1981
DE 30 23 570 A1 1/1982
DE 43 12 902 A1 10/1994
FR 2 460 445 1/1981

OTHER PUBLICATIONS

International Search Report mailed Mar. 8, 2006.

* cited by examiner

*Primary Examiner*—Kenneth Rinehart
(74) *Attorney, Agent, or Firm*—Merchant & Gould P.C.

(57) ABSTRACT

A method and apparatus for delivering biomass fuel to a structure through an external wall of the structure is disclosed. The apparatus comprises a hopper disposed within a delivery vehicle. The hopper includes an inlet disposed on its top surface to receive biomass fuel and an outlet located proximate the bottom of the hopper to release the fuel by opening a gate valve. A delivery hose is connected to the hopper outlet at one end and is sealably connectable at its other end to an externally accessible coupling disposed on an external wall of the structure to which fuel is to be delivered. The coupling is connected on the interior side of the external wall to a delivery pipe that connects to a fuel bin for storing the biomass fuel. Sensors within the bin can signal the operator when the level of fuel within the bin reaches a preselected level, allowing the operator to stop delivery when the bin is full.

8 Claims, 9 Drawing Sheets

APPARATUS AND METHOD FOR DELIVERY OF BIOMASS FUEL

This application is a continuation-in-part of application Ser. No. 10/835,620, filed Apr. 28, 2004, now abandoned which is a continuation of application Ser. No. 10/630,371, filed Jul. 30, 2003, now abandoned which application(s) are incorporated herein by reference.

BACKGROUND OF THE INVENTION

The present invention relates to a method of delivering quantities of biomass fuel to a structure through an external wall of the structure.

"Biomass fuel" refers to fuel that is derived from biological material, either in a raw or processed state. Non-limiting examples of biological material suitable for use as a source of biomass fuel include trees, grass (including yard clippings), wood chippings or sawdust, waste paper, shelled corn and agricultural waste such as poultry and hog waste.

Because biomass fuel is derived from biological material, it serves as a renewable energy source that can be utilized in place of traditional fossil fuels, such as oil or natural gas. The heat generated from the combustion of biomass fuels can be used directly to heat residential, commercial, and industrial structures. Alternatively, the heat can be used to generate steam in the generation of electricity for other uses.

Wood furnaces have long been used in residential homes as a source of heat, but more general-purpose biomass furnaces capable of generating heat from diverse types of plant-derived fuel are also widely available. These furnaces are often designed to accept biomass fuel in the form of small pellets. The user of a biomass furnace must maintain a supply of these pellets to refill the furnace as needed, typically in the form of large, heavy bags or other storage means. The user of the furnace must purchase the fuel, load it into a vehicle for transportation to the site of use, unload the fuel, and provide storage space until the fuel is needed.

Alternatively, the user of the furnace can contract with a delivery service to provide the fuel as needed. This option, however, requires that the delivery person enter the home or other structure to replenish the fuel supply. In such cases, the occupant of the structure must make arrangements to be onsite when the delivery service arrives, or, alternatively, grant the delivery service access to the structure in his or her absence. Not surprisingly, many owners are reluctant to give individuals they do not know access to their dwellings or businesses.

SUMMARY OF THE INVENTION

The method of the present invention is able to avoid this problem by providing a convenient method of delivering biomass fuel to a residential or other structure without any need for the delivery person to enter into the structure, or for the owner to lift the heavy containers containing the fuel.

The present invention also is directed to a delivery device that is useful for the method. The device comprises a hopper that is carried by a vehicle such as a truck. The hopper carries fuel that is delivered from the hopper to a fuel chamber within the customer's structure via a delivery hose. A pump provides compressed air for delivering fuel from the hopper through the delivery hose. The pump produces a relatively low pressure of, for example, about 1–10 psi, preferably about 3–7 psi. The hopper also comprises a sealable inlet opening at the top through which biomass fuel is loaded into the hopper's interior. A second outlet for discharging the hopper's contents is located at the bottom of the hopper, and is controlled by a gate valve. To discharge the hopper's contents through the discharging outlet and into the delivery hose, the gate valve is opened when the air pump is running. The device also may be used for delivery of other materials in granular or pellet form, such as animal feed or ice melter.

In order for the biomass fuel to be delivered to the interior of the home or other structure that may be located outside the home or business, a biomass delivery pipe or conduit typically is installed between the biomass fuel chamber and a coupling on the exterior of the structure to which the delivery hose can be connected, although it is possible that the delivery hose could be passed through the wall to reach the fuel chamber or a delivery pipe. Typically, the biomass fuel chamber is a chamber separate from, and located proximate to, the biomass furnace or stove itself. Alternatively, the biomass furnace or stove itself may comprise the fuel chamber to which fuel is delivered by the method of the invention.

The device utilized by the method additionally may include a measuring device to measure the quantity of fuel delivered to the biomass fuel chamber. In one embodiment, the delivery vehicle may be provided with a scale so that the weight of the material delivered can be measured. In another embodiment, when the fuel chamber is full a change in air pressure may be used to disengage the air supply or provide a suitable signal for the delivery person. After delivery of a satisfactory quantity of fuel, the delivery person will close the gate valve of the hopper and disconnect the delivery hose from the external coupling. Other methods for measuring the quantity of fuel delivered and/or when the fuel chamber is full also may be used.

DETAILED DESCRIPTION OF THE INVENTION

The method of the invention provides a convenient way to deliver biomass fuel directly to the interior of a structure without the need for the delivery personnel to enter the structure itself. The owner of the structure, therefore, obtains the convenience of receiving biomass fuel without having to be present for the delivery, and with the added advantage of not having to load and unload the heavy containers of biomass fuel. It is contemplated that the method will be useful not only for residential structures that utilize biomass fuel furnaces, but also for commercial structures, including industrial structures.

In one embodiment, the method utilizes a conduit that passes from an exterior of the customer's structure to a fuel chamber for the biomass fuel. The biomass fuel is delivered by airflow through a delivery hose from a delivery vehicle through the conduit.

The method disclosed herein is designed to deliver biomass fuels for generating energy for use in a wide variety of applications. It is expected that the fuel delivered by the method may be burned, for example, in stoves and furnaces to generate heat for residential, commercial or other structures, or as a source of heat for water heaters, corn driers, pool heaters, and other heating applications.

The biomass fuel delivered by the method may be comprised of differing material. Producers of biomass fuel may alter the content of the fuel in response to changes in the supply and/or pricing of raw materials used in its generation. The content of biomass fuel also can vary geographically, in response to localized differences in the types of material most widely available to create the fuel. In some cases, traditional fossil fuels may be added and comprise a percentage of the finished biomass fuel product.

The size of biomass fuel pellets also can vary depending upon the content of the fuel and its intended use. Typically, the size of biomass fuel pellets may range from granular in size up to about ¾ in diameter. In a preferred embodiment, the pellets range in size from about ⅛ inch to about ½ inch.

The energy content of the biomass fuel will vary with the content of the fuel. The typical range of biomass fuel energy content is from about 5000 to about 15,000 BTU/lb. In a preferred embodiment of the invention, the energy content is from about 7000 to about 11,000 BTU/lb.

Biomass fuel typically burns almost completely under the appropriate conditions, leaving behind only an ash that is often composed primarily of nutrients that are not combustible. This ash, therefore, can be reclaimed for use as fertilizer on crops or cultivated plants.

Figure 1:
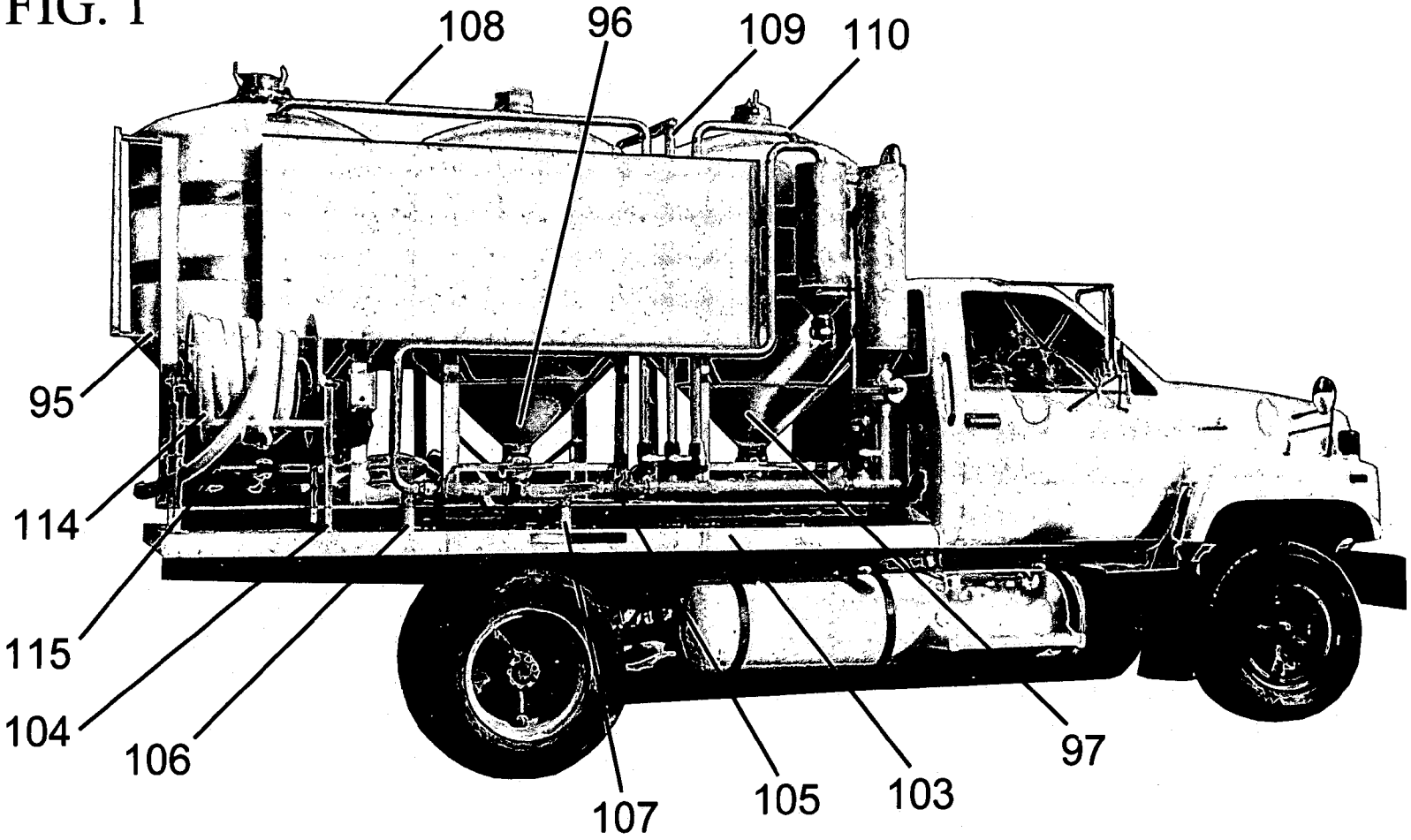
FIG. 1 is a view of a delivery truck as from one side thereof, and comprising a biomass fuel delivering apparatus.

An example of a delivery apparatus useful for the present method is seen in FIGS. 1–4. As shown in FIG. 1, a delivery truck carries hoppers that contain the biomass fuel to be delivered to customers. In the illustrated embodiment, three hoppers, 95, 96, and 97 are carried by the delivery truck. This can be changed if necessary. It is useful to provide plural smaller hoppers instead of one large hopper, as this reduces the time necessary to pressurize the hopper during delivery of the biomass fuel.

The truck is provided with a bed 103. The bed can be provided with a support structure to support the hoppers and other elements such as canisters, piping, delivery hose roller, etc., as needed. A catwalk type structure may be provided if desired, to facilitate access by workers to the upper levels of the hoppers or other elements.

In the illustrated embodiment, the hoppers have a generally cylindrical main body. The top of the main body is closed with a dome-like structure. The bottom of the main body is closed with a frustoconical structure, the bottom of which is provided with a gate, e.g. a gate valve. This may take the form of a butterfly valve structure operated with a lever, as illustrated in FIGS. 6A–C. The top of the hopper is provided with an opening that can be closed and sealed by a cover. Material to be delivered is supplied to the hopper through this opening. One example of the cover can be seen in FIG. 5, which is discussed below. The cover should be able to withstand the pressure to which the hopper is subjected during delivery to the customer, typically up to about 10 psi. The hoppers can be made of stainless steel, molded resin or any other material compatible with the material to be delivered and capable of carrying the material to be delivered and withstanding the pressure exerted during delivery of fuel without undue deformation. The walls of the frustoconical structure should be sloped sufficiently to permit adequate product flow from the hopper. However, if the slope is too great relative to horizontal, the capacity of the hopper is reduced, which reduces efficiency. In the illustrated embodiments, the walls of the frustoconical structure are at an angle of about 45 degrees relative to horizontal. The size of the hopper may be selected as desired, taking into consideration the optimal flow of material to be delivered and the desirability of reducing the time needed to pressurize the hopper. In one example, a hopper may be about 47 inches in diameter, and have a height of about 80 inches. Such a hopper is capable of holding about 2200 pounds of biomass fuel. The hopper may take other forms and use other sealing or gate valve components if desired.

In the present embodiment, it generally is expected that the hopper(s) will remain on the delivery truck on an ongoing basis. Thus, the hopper(s) typically will be filled with biomass fuel or other material to be delivered to a customer from an overhead supply system. In other embodiments, the hoppers may be removed readily from the delivery truck.

Figure 2:
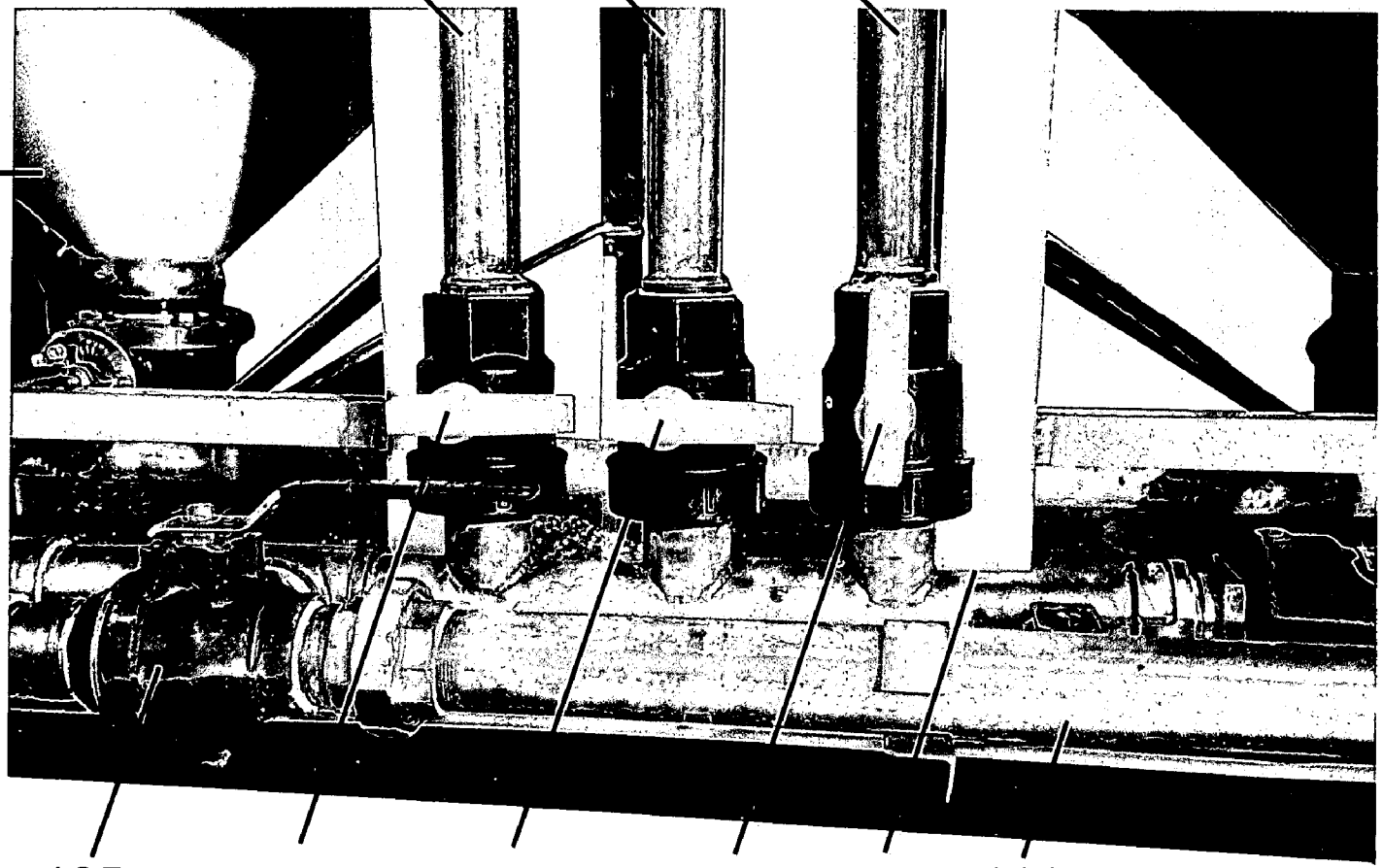
FIG. 2 is a view of a valve system allowing delivery of biomass fuel from one of three hoppers to a delivery hose.

Piping elements 108, 109 and 110 are provided for delivering air under pressure to the top areas of the hoppers 95, 96 and 97 respectively. As seen in FIG. 2, the flow of air through these piping elements may be controlled with valves 98, 99 and 100. This air flow is used to equilibrate pressure at the top of the hoppers 95, 96, and 97, which facilitates the delivery of biomass fuel or other material from the hopper as discussed below.

Figure 3:
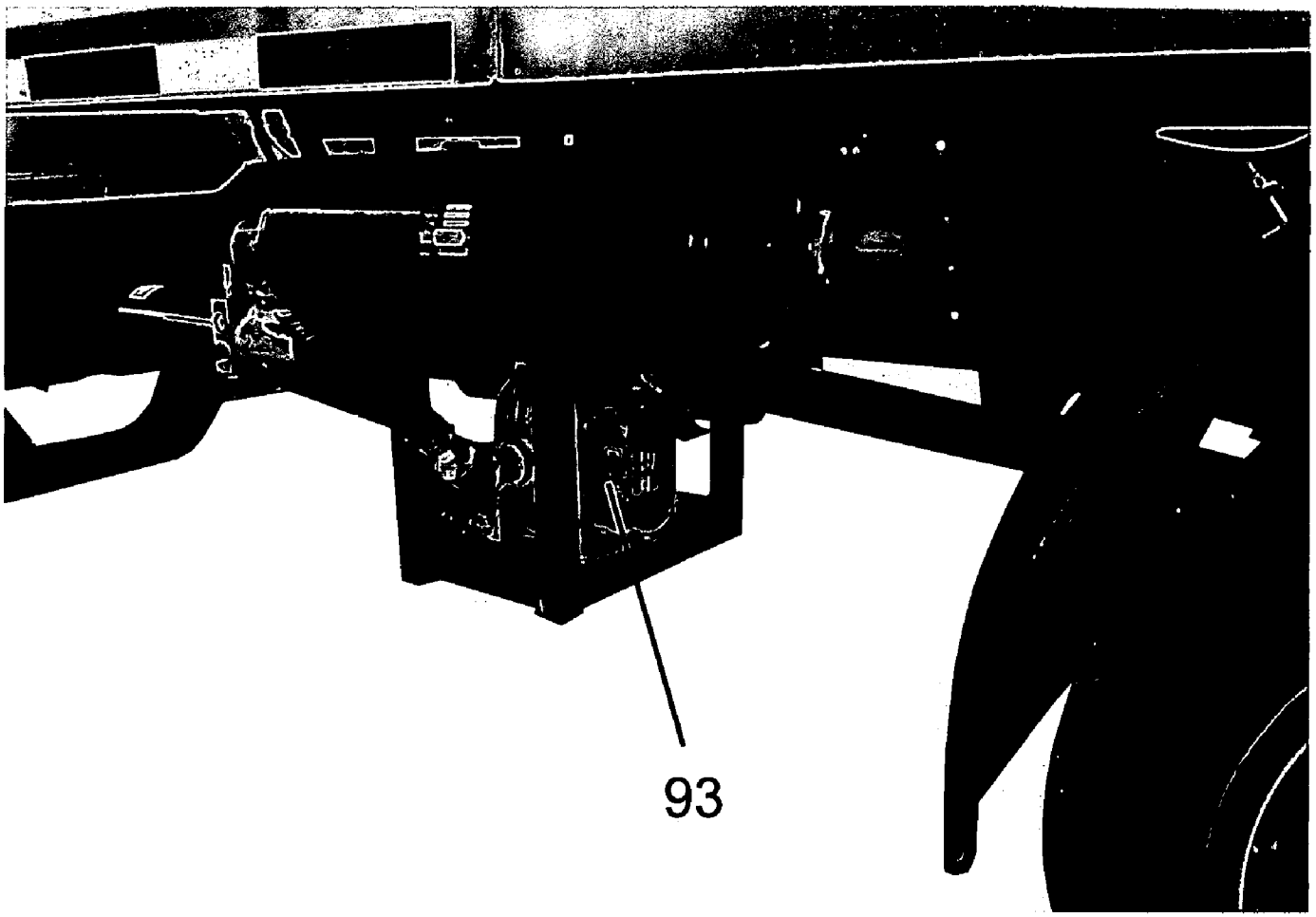
FIG. 3 is a view of a truck power take-off system used for generating power to operate an air pump on a biomass fuel delivery apparatus.

As shown in FIG. 3, the delivery apparatus includes an air pump 93. In this embodiment, the air pump is located on the underside of the delivery truck bed, and is carried by a suitable support cage. Other locations and arrangements can be used as well. The air pump is driven by a power take off (PTO) connection to the delivery truck's transmission system. In the illustrated embodiment the air pump is driven directly by from the PTO. It is possible to provide a further drive element between the air pump and the PTO. For example, a hydraulic motor could be interposed, with the PTO driving the hydraulic motor, which in turn drives the air pump. Alternatively, a separate drive system could be provided for the air pump, for example an electrical drive system that could be connected to the truck's delivery system, or a system isolated completely from the truck and powered by battery or an internal combustion engine. The embodiment that makes use of the PTO is desirable because of its simplicity and reduction in the number of parts. Piping elements 106 and 107 are connected to the air pump inlet (vacuum side) and outlet (pressure side) respectively, and pass upward to the upper side of the delivery truck bed for connection to other piping elements as discussed below. A silencer may be provided on the outlet side of the air pump. An air pump capable of providing 100 cfm of air at 8 psi at a speed of 1600 rpm is useful. Such a pump is available from Sutorbilt.

Figure 7:
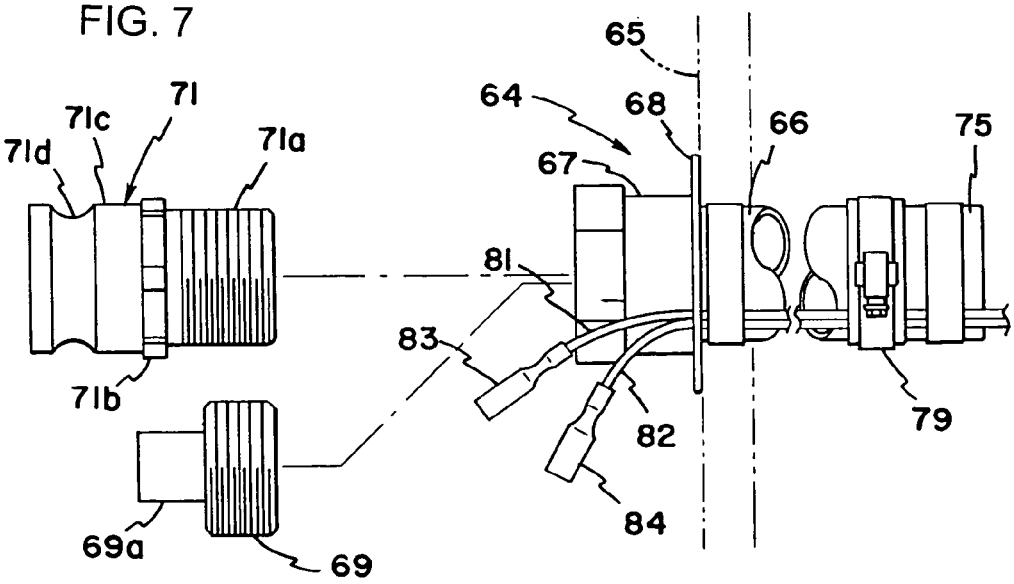
FIG. 7 is a side elevation of a portions coupling between the biomass fuel delivering apparatus and a residential in feed pipe.
Figure 8:
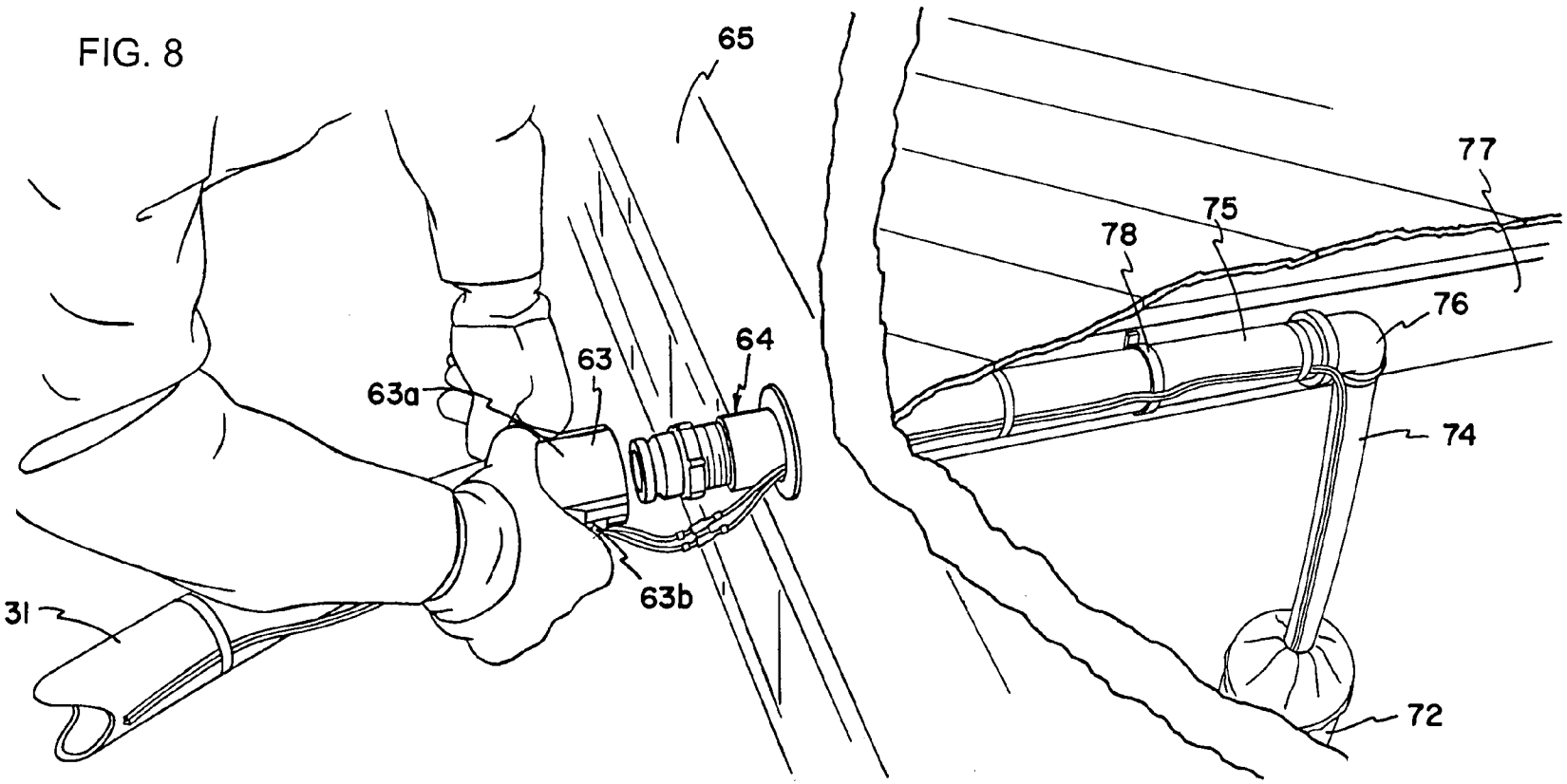
FIG. 8 is an enlarged fragmentary perspective view showing the coupling of FIG. 3 with the in feed pipe and residential fuel chamber.

A further piping element 115 runs beneath the hoppers 95, 96 and 97. The gate valves at the bottom of these hoppers are in communication with this piping element, so that biomass fuel or other material in the respective hoppers can pass into this piping element when the hopper's gate valve is opened. The piping element 115 may have an inner diameter of 2 inches and be made of stainless steel. Other sizes and materials may be used. The same is true for other piping elements discussed below. A delivery hose 114 is provided at the end of this piping element. The free end of the delivery hose 114 may be provided with a coupling member for engaging the delivery conduit at the customer's premises. An example is illustrated in FIGS. 7 and 8. Other systems could be used if desired. The delivery hose will have a length suitable for extending from the delivery truck to the customer's premises. For example, 150 feet may be suitable.

The connection from the air pump 93 to the delivery hose 114 now will be described with reference to FIGS. 1, 2 and 4. The piping element 106 is in communication with piping element 111 and piping element 107 is in communication with piping element 112. Piping element 111 is provided with two three way valves 104 and 105. Piping element 111 is in communication with piping element 112 through the valve 105 at a point downstream from the communication with piping element 107. The piping elements 108, 109 and 110 are in communication with the piping element 112 downstream of the valve 105. Downstream of piping elements 108, 109 and 110 the piping element 112 terminates, although a pressure relief valve may by provided if desired. The piping element 111 is in communication with the end of piping element 115 opposite to the end connected to the delivery hose 114.

One or more relief valves may be provided as needed. These can be provided on the hoppers if desired, or they may be provided on a piping element, which would be closer to the air pump.

Figure 4:
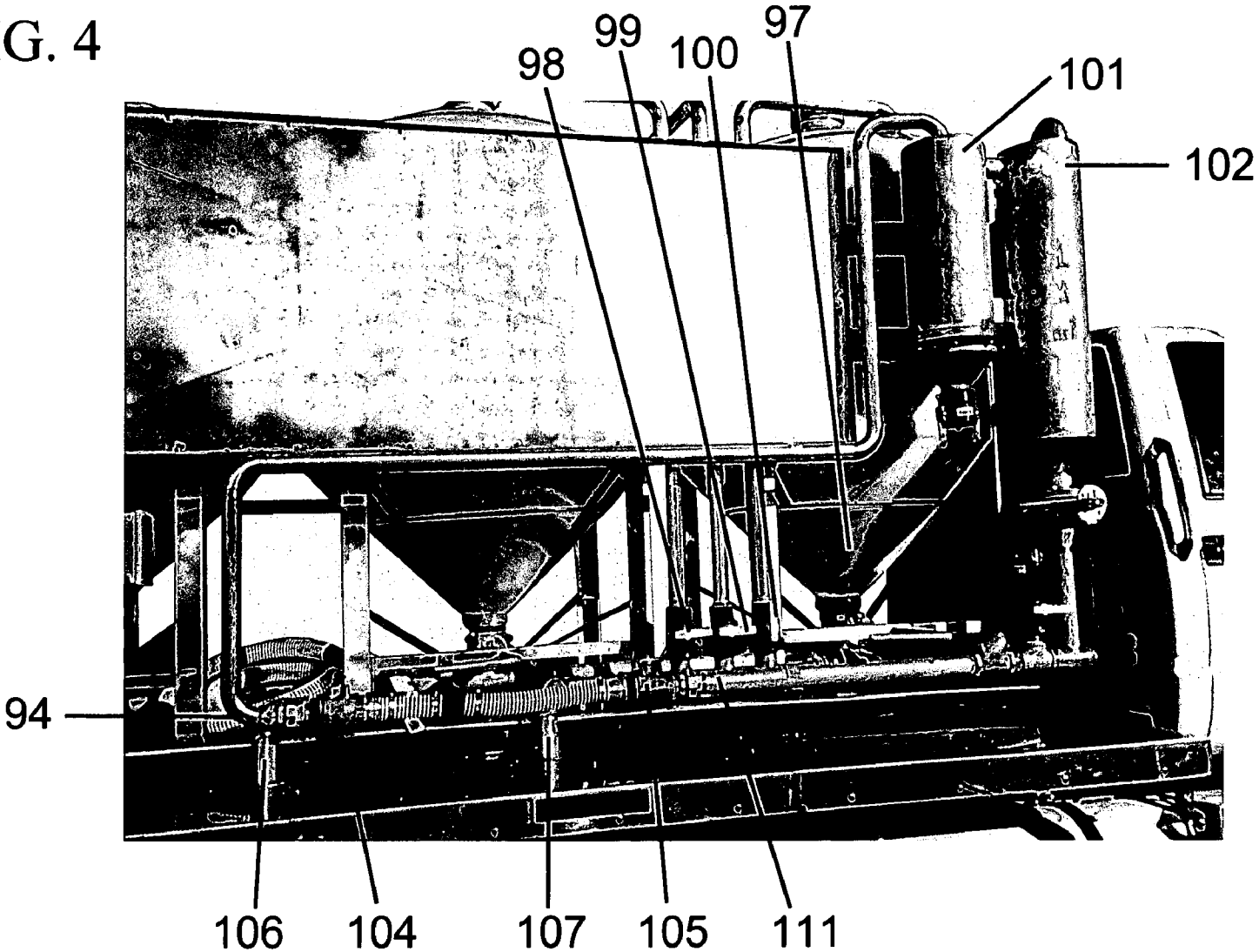
FIG. 4 is a detailed side view of a truck carrying a biomass fuel delivery apparatus.

Referring to FIGS. 1 and 4, the illustrated embodiment is provided with a reclamation system, e.g. for collecting ash resulting from the combustion of biomass fuel from a customer's premises. Canister 102 is in communication with piping element 115, for example through a pipe element connected to an inlet in the top of the canister 102 in the illustrated embodiment. This piping element extends downwardly from the top of the canister 102 to a T-junction or other suitable structure for establishing communication with the piping element 115 that runs beneath the hoppers 95, 96 and 97. A material outlet may be provided at the bottom of canister 102, which may be in communication with the piping element 111 through a gate valve. This is convenient for removing material from the canister 102 in a similar manner to the delivery of material from the hoppers 95, 96 and 97. A check valve or other structure may be provided to prevent flow of air from the piping element 111 into the canister 102 if necessary. The air outlet of the canister 102 is in communication with the piping element 106 (inlet side of the pump) through the valve 104. Suitable piping elements are provided as needed to establish the communication between the air outlet of the canister 102 and the valve 104. A filter element, for example filter canister 101, may be provided between the air outlet of the canister 102 and the valve 104. The reclamation system can be used, for example, to remove ash from a customer's furnace via the delivery hose 114. The reclaimed material can be collected in the canister 102. In the case of reclaimed ash from biomasss fuel, the ash is useful for fertilizers as noted above. In this case, the customer's premises may be provided with a separate conduit for access to an ashpot for the furnace. The system also could be used to collect residual undelivered material from the delivery hose.

As shown in FIG. 4, the delivery truck is provided with weighing scale 94 disposed on the bed of truck 12. The weighing scale can comprise any suitable scale, such as a NORAC® scale, that is NTEP approved for selling products by weight. Scale 94 is designed to read a weight that includes the weight of the biomass fuel in the hopper(s). The operator can monitor the weight during fuel delivery, and stop the biomass fuel discharge after a satisfactory amount of biomass fuel has been discharged. For example, a customer may be provided with a certain amount of fuel on a regular delivery schedule, or a customer may request a specific amount of fuel. This embodiment, therefore, allows the operator to deliver an amount by weight of biomass fuel. Other methods for determining the delivery of a satisfactory quantity of biomass fuel by evaluating the quantity of fuel delivered and/or determining when the fuel chamber is full may be used.

The operation of the apparatus now will be described. At the beginning of the delivery route, if necessary, the hopper(s) 95, 96 and 97 are filled with a quantity of biomass fuel selected to ensure that sufficient fuel is available for all deliveries on the route. The filling may be accomplished by an overhead loading system under which the delivery truck is driven, or a conveyor or delivery hose that can be brought to the opening in the top of the hopper. The gate valve(s) at the bottom of the hopper(s) is closed at this point. After the hopper is filled to the desired level, the fill opening is closed with its sealing cover.

After the hopper has been transported to a location where biomass fuel or other material is to be delivered, the operator starts the air pump 93 by engaging the PTO. At this time, the valve 105 is set so that air can flow from the pump outlet through piping element 107, to piping element 112, through valve 105 and to piping element 111. The valves are set so that the piping element 106 is isolated from piping element 112, and air should not flow into the canister 102. Thus, air flows to the piping element 115 from the piping element 111, providing positive airflow through the delivery hose 114.

After coupling the delivery hose to the customer's delivery conduit, the gate valve of one of the hoppers 95, 96 or 97 is opened, so that biomass fuel or other material contained in that hopper flows into the piping element 115, for example under the influence of gravity. At this time the valve 98, 99 or 100 for the hopper used as a delivery source should be open (the valves for the other hoppers being closed), so that air pressure in the piping element 112 also is provided to the top of that hopper through the respective piping element 108, 109 or 110. This ensures that the pressure in the top of the hopper is approximately equal to the pressure in the piping element 115, which is important in reducing the tendency of the pressure in the piping element 115 to prevent the flow of material from the hopper into the piping element. It is preferable to have the air flow to the top of the hopper precede the opening of the gate valve by a time sufficient for the air flow to pressurize the space at the top of the hopper. The material delivered to the piping element 115 from the hopper is carried by the air flow through the delivery hose 114 and the conduit of the customer's premises to the fuel chamber. The operator can monitor the amount of material delivered and close the gate valve or interrupt the air flow at an appropriate time (e.g. when a satisfactory amount has been delivered), a system providing a signal for the operator to stop delivery at an appropriate time can be provided or an automatic system that stops delivery at an appropriate time without intervention of the operator can be used. The operator then removes the delivery hose from the customer's premises and returns it to the truck to drive to the next delivery location.

The following describes the operation when material such as ash is to be removed (reclaimed) from the customer's premises. In this case, the valve 105 is set to isolate the piping element 107 from the piping element 111 (and thus from piping element 115. The valve 104 is set so that piping element 106 communicates with the air outlet of canister 102 (with the filter canister 101 being interposed therebetween in the illustrated embodiment). In this case, the vacuum at the pump inlet supplied acts on the delivery hose 114 through piping element 106, canister 102, and piping element 115. Thus, the negative pressure will draw material through the delivery hose and piping element 115 to the canister 102. The canister 102 will collect the majority of particulates picked up through the delivery hose. The filter canister 101 can be provided to ensure that any particulates escaping from the canister 102 are not carried to the air pump.

It is possible to empty canister 102 using piping element 111, piping element 115 and the delivery hose 114. In this case, the valve 105 is set to allow positive airflow from piping element 107 to the piping elements 111 and 115 and delivery hose 114. The gate valve for the material outlet at the bottom of canister 102 is opened, allowing reclaimed material in the canister 102 to flow into the piping element 111, to be carried to delivery hose 114 through piping element 115.

In the illustrated embodiment, both the product delivery system and the reclamation system share common elements, i.e. piping element 115. This is desirable in simplifying the structure and reducing costs. It would be possible to provide parallel systems if desired.

Figure 5:
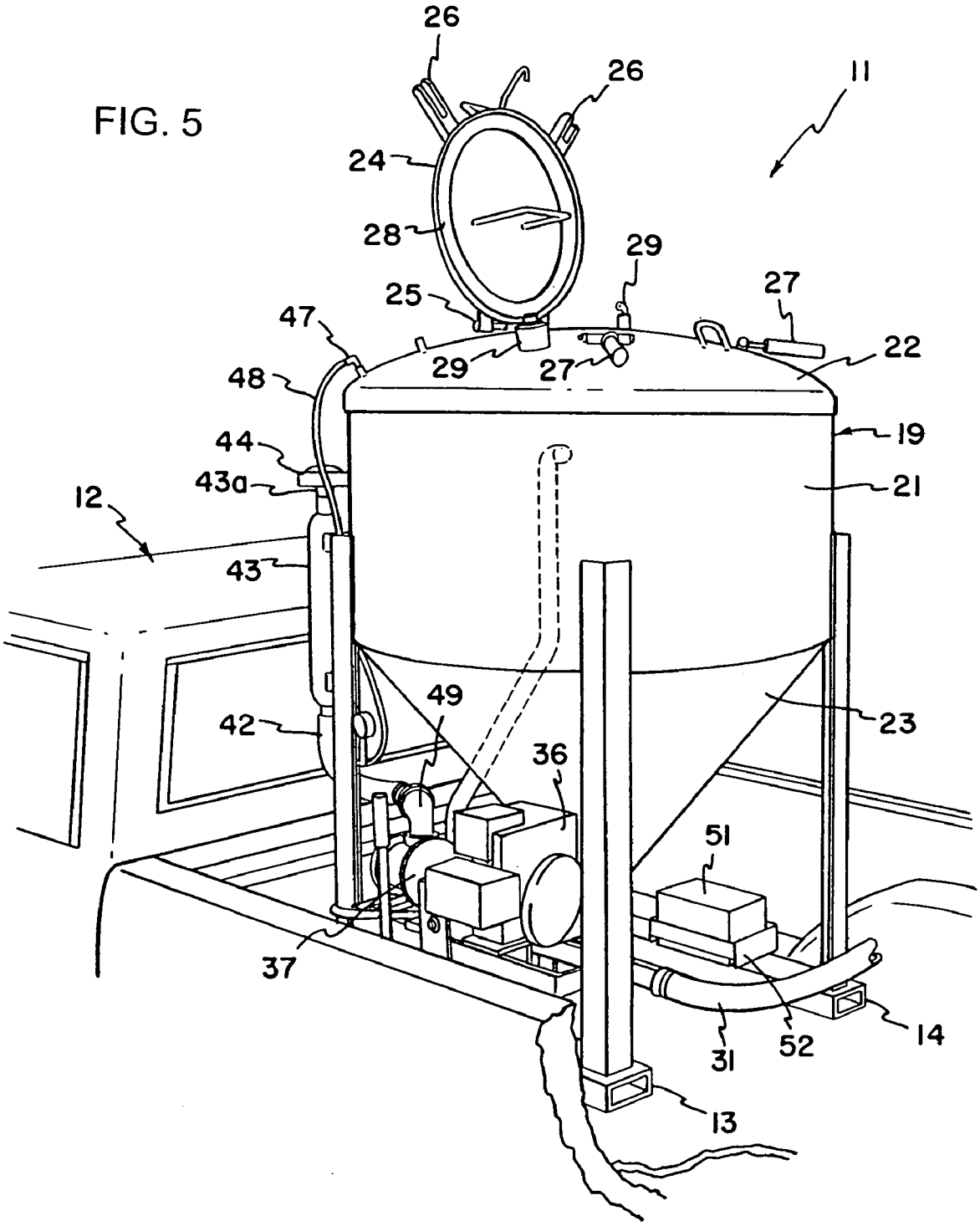
FIG. 5 is a fragmentary perspective view of a further embodiment of a biomass fuel delivering apparatus disposed in the bed of a delivery vehicle.

With reference to FIG. 5, in a second embodiment a biomass fuel delivering apparatus 11 is positioned within a delivery vehicle 12. In this case, the apparatus is of a smaller scale and is in a self-contained unit that readily can be placed on and removed from a delivery vehicle. The apparatus 11 comprises a sealed hopper 19 that contains the biomass fuel. In the preferred embodiment, hopper 19 comprises a cylindrical main portion 21, a dome-shaped top 22 and a frustroconical lower portion 23. The domed top 22 has a centrally disposed circular opening (not shown) which is sealed by a circular cover 24 that is pivotally mounted to the top 22 by a hinge 25. Sealed top 24 includes a pair of laterally projecting bifurcated ears 26 that interlockably engage a pair of handle clamps 27 when the cover is placed in sealing position. The handle clamps 27 interlockably engage the bifurcated ears 26 and operate in an over-center manner when lowered to clamp the cover 24 in sealed relation to top 22. A resilient annular seal 28 is positioned on the inner peripheral edge of cover 24, and creates an airtight seal with top 22. The dome-shaped top carries a pressure relief valve 29. In some embodiments, biomass fuel delivery apparatus 11 may comprise more than one hopper 19.

With reference to FIG. 5, an outlet fitting having a gate valve 30 is disposed at the lower end of the frustroconical portion 23 of hopper 19. Gate valve 30 leads to a biomass fuel delivery hose 31. The gate valve 30 is actuated by a horizontal linkage member 32 (FIG. 2), which is moved by an upright handle member 33. A fixed linkage member 34 is secured to a cross frame member 35. Handle member 33 is pivotally connected to both of the linkage members 32, 34, enabling the user to open the gate valve 30 by pushing handle 33, and to close the gate valve by pulling handle 33.

Apparatus 11 additionally comprises a pair of horizontally disposed, parallel frame members 13, 14 that form the base of apparatus 11. Frame members 13, 14 each comprise an elongated steel tube of rectangular cross section. Frame members 13 and 14 are sized and spaced apart such the prongs of a conventional forklift can enter between them to lift apparatus 11 out of delivery vehicle 12.

Figure 6:
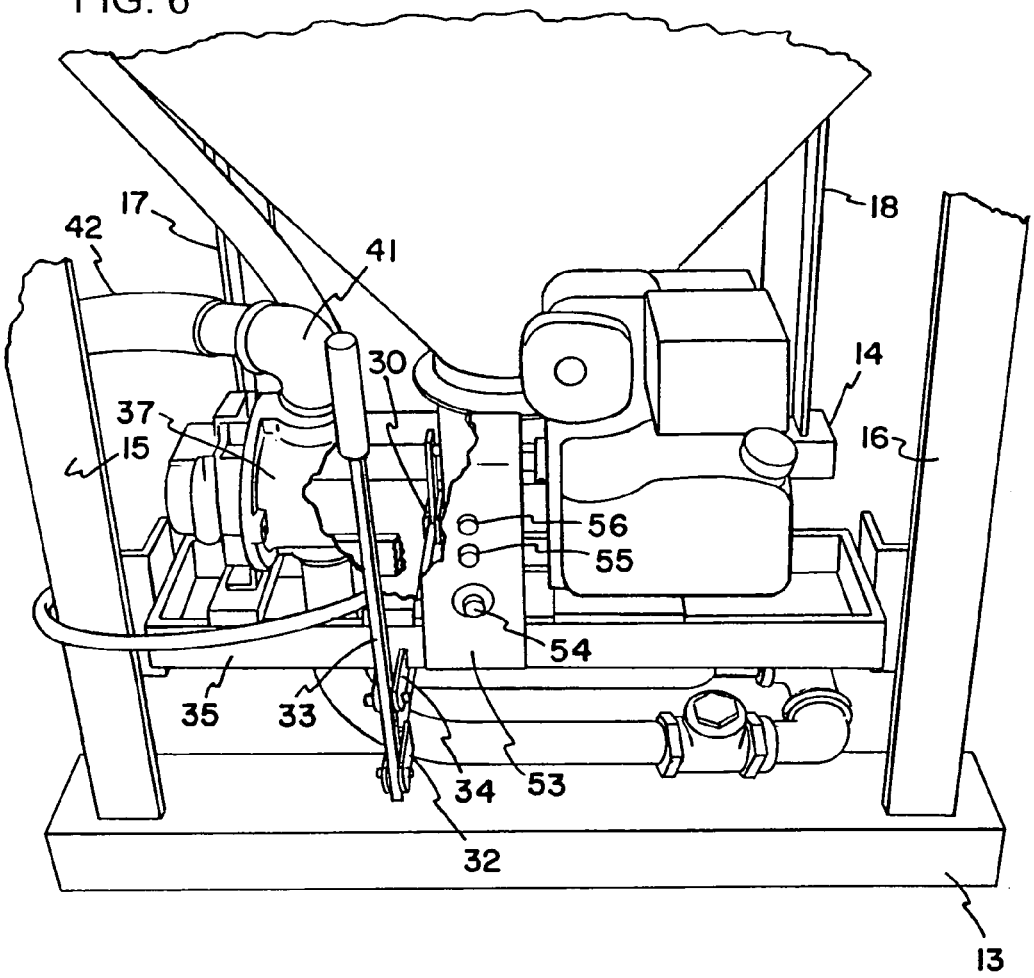
FIG. 6 is an enlarged fragmentary perspective view of the biomass fuel delivering apparatus as viewed from one side thereof.
Figure 6A:
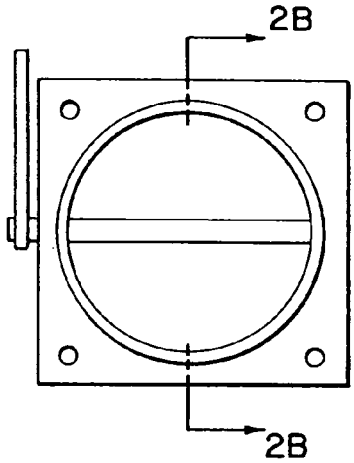
FIGS. 6A–C illustrate a valve structure, with 6A being a top view and 6B and 6C being sectional side views of the closed and open positions.
Figure 6B:
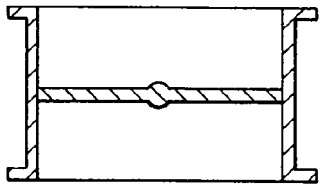
Figure 6C:
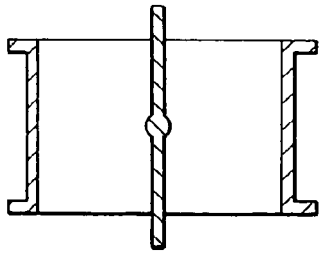

With additional reference to FIG. 6, two vertically disposed frame members 15, 16 are secured to (as by welding) and project vertically upward from the frame member 13 at the respective ends thereof. Similarly, vertical frame members 17, 18 are secured to and project upward from horizontal frame member 14. Vertical frame members 15–18 are preferably formed from angle iron with the inner faces thereof facing inward to receive and support a hopper 19.

With continued reference to FIGS. 5 and 6, an air outlet pipe or hose 45 projects out of an outlet fitting of air pump 37 (not shown) and is connected to an elbow fitting 46 secured to the side of hopper 19. As indicated above, the outlet pressure of air pump 37 is preferably on the order of 3 psi, and this pressure is communicated through hose 45 and fitting 46 to the inside of sealed hopper 19, exerting pressure in this amount on the biomass fuel disposed within the hopper 19. Further, air pump 37 operates at a comparatively low speed, which results in a pulsating effect that promotes the discharge and delivery of biomass fuel pellets as discussed in further detail below.

With reference to FIG. 5, hopper 19 includes small pressure fitting 47 mounted on the dome shaped top 22. The operator is able to monitor the pressure within hopper 19 utilizing pressure gauge 49, which is connected to fitting 47 via flexible pressure tube 48. As previously discussed, pressure relief valve 29 is also mounted on dome shaped top 22, and will open if the pressure within hopper 19 reaches a limit of about 25 psi. If the pressure within hopper 19 exceeds 3 psi by any significant amount, however, back pressure will build up through hose 45 to air pump 37 that tends to backload the pump and hence engine 36, causing engine 36 to cease running.

With continued reference to FIGS. 5 and 6, a gasoline engine 36 is mounted to the cross frame member 35. In one preferred embodiment, engine 36 is a relatively small four-cycle internal combustion engine, and in one embodiment has a five-horse power output.

With reference to FIG. 5, battery box 52 is mounted to horizontal frame member 14. Battery box 52 contains battery 51, which starts engine 36 and is maintained in a charged state by the engine generator (not shown). Battery 51 also provides voltage to an indicator circuit as discussed in further detail below.

With reference to FIG. 6, apparatus 11 also comprises a small control panel 53. Panel 53 includes a push button start switch 55 for engine 36, an on-off switch 54 for engine 36, and an indicator light 56 that signals the operator to cease delivering biomass fuel, as described in more detail below.

With reference to FIG. 6, engine 36 utilizes a conventional driving connection (not shown) to drive conventional air pump 37. The driving connection includes a rubber drive wheel connected to engine 36 and a rubber driven wheel connected to air pump 37. The operating speed of air pump 37 is controlled by the relative diameters of the drive and driven wheels. The driving function results from the frictional engagement of the peripheries of the drive and driven wheels. In the preferred embodiment, the speed of air pump 37 is controlled to result in a relatively low pressure output. Air pump 37 includes a pressure regulating valve (not shown) to control its output, which in the preferred embodiment is about 3 psi.

With continued reference to FIGS. 5 and 6, an inlet fitting 41 is secured to an inlet of air pump 37, disposed on its top surface. As best shown in FIG. 1, a flexible hose 42 interconnects inlet fitting 41 and a vertically disposed air intake 43. A rain cap 44 prevents rain from entering air intake 43.

With reference to FIG. 5, it is helpful to maintain the pellets in as dry a state as possible to ensure that the biomass fuel pellets flow smoothly during discharge. Therefore, the air inlet of air intake 43, which bears reference numeral 43*a* (the portion covered by rain cap 44), is of smaller inside diameter than that of the main body of air intake 43. As such, when air is drawn through the inlet 43*a*, it expands into the main body portion, reducing pressure and causing moisture in the air to condense before entering the air pump.

The length of biomass fuel delivery hose 31 is designed such that it can reach from the biomass fuel delivery apparatus 11 to the external coupling of a residence or other structure as described in further detail below. In the preferred embodiment, biomass fuel delivery hose 31 is about 150 feet in length.

With reference to FIG. 8, the extreme end of hose 31 terminates in a mechanical coupling 63 that will be discussed in further detail below. With reference to FIG. 7, hose coupling 63 is sealably interconnectible with an external residence coupling bearing the general reference numeral 64. Coupling 64 spans external residential wall 65, and includes an external portion including an internally threaded coupling 67 and a flange 68 that lies against the residential wall 65, as well as an internal portion taking the form of a pipe 66. Normally, an externally threaded plug 69 is screwed into the coupling 67 to close it. A square projecting boss 69*a* enables the plug 69 to be wrenched in or out. The operator of delivery apparatus 11 removes plug 69 prior to commencing delivery of the biomass fuel, and replaces it with a threaded coupling 71 having an externally threaded portion 71*a* that screws into the coupling 67 and a toothed ring 71*b* that is used to grip the coupling 71. Outwardly of toothed ring 71*b* is a connecting portion 71*c* having an annular groove 71*d*.

With combined reference to FIGS. 7 and 8, hose coupling 63 is sized to fit over coupling 71. Hose coupling 63 includes a sealing O-ring (not shown) that seats into the annular groove 71*d*. Coupling 63 has a pair of clamping wings 63*a*, 63*b* which, when pressed flat against coupling 63, cause the O-ring to compressibly seal against the annular groove 71*d*. Outward lifting of the wings 63*a*, 63*b* releases the internal O-ring and permits the coupling 63 to be removed from coupling 64.

With continued reference to FIG. 8, coupling 64 is located in proximity to a biomass fuel bin 72, which in turn is located adjacent a biomass fuel furnace (not shown). Biomass fuel furnaces are often located in the lower level of the residential or other structure, and the coupling 64 is accordingly depicted in FIG. 8 in a position relatively close to the ground where it is accessible to the biomass fuel delivery operator.

In some embodiments, fuel bin 72 may not be located within a residence, commercial or other structure. In these cases, bin 72 may be located outdoors. In this case, coupling 71 may be located directly on bin 72, and coupling 63 is sized to fit over coupling 71. Alternatively, bin 72 may not have a coupling 71, and fuel may be discharged directly to the interior of the bin via an opening such as a hatch or door disposed on the exterior surface of bin 72.

Figure 9:
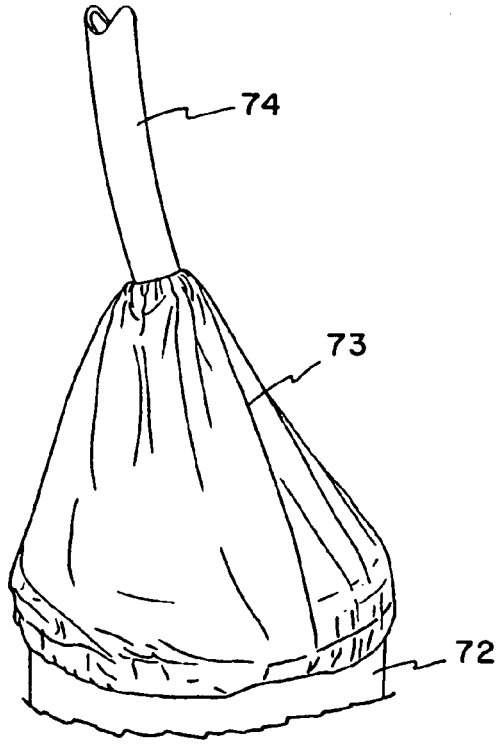
FIG. 9 is a fragmentary view inside elevation of the fuel chamber, in feed pipe and cover.
Figure 10:
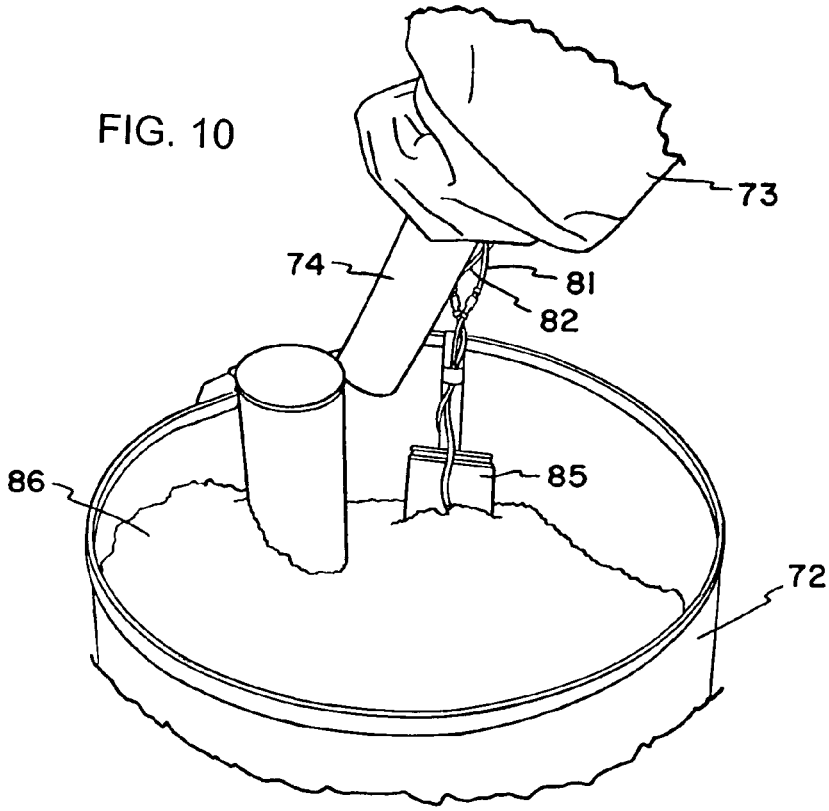
FIG. 10 is an enlarged fragmentary perspective view of the fuel chamber and in feed pipe.

With reference to FIGS. 9 and 10, bin 72 includes a flexible dust/filter bag 73 to accommodate the biomass fuel delivering apparatus 11. Flexible dust/filter bag 73 has a large open lower end with an elastic periphery that fits over the top opening of bin 72, and a smaller top elastic opening that receives a flexible biomass fuel delivery pipe 74. With reference to FIG. 8, flexible pipe 74 is connected to a rigid pipe 75 through an elbow fitting 76. Rigid pipe 75 is secured to a floor joist 77 or similar structure by a plurality of straps 78. With additional reference to FIG. 7, pipe 75 is coupled to the internal pipe 66 of coupling 64 by a pipe clamp 79.

The device also may include a system to signal the operator when the level of biomass fuel within bin 72 is full so that delivery of the fuel should be stopped. When the fuel chamber is full, a change in air pressure is recognized and subsequently disengages the air supply. The delivery person will then close the gate valve and disconnect the delivery hose from the external coupling.

The portability of apparatus 11 allows it to be transported from location to location via a delivery vehicle 12, such as, for example, a flat bed truck or pick-up truck when single hopper delivery is desired. Thus, apparatus 11 is ideal for the method of the invention, in which biomass fuel is delivered to varying locations. It is contemplated that deliveries can be made at preestablished intervals. A step-by-step exemplification of the delivery process now follows.

At the beginning of the delivery route, the operator fills hopper 19 with a quantity of biomass fuel selected to ensure that sufficient fuel is available for all deliveries on the route. To fill the hopper 19, the operator releases the clamping valves 27 and lifts the cover 24 to the position shown in FIG. 5. The filling may be done from an overhead hopper under which the apparatus 11 is driven, or a conveyor or delivery hose that can be brought to the mouth of hopper 19. Handle 33 is pulled to close the gate valve 30 prior to delivery (see FIGS. 6A and 6B). After hopper 19 is filled to the preselected level, the operator closes cover 24, which is then sealably clamped over the hopper opening using handles 27.

After the hopper has been transported to a location where biomass fuel is to be delivered, the operator starts engine 36 by moving on-off switch 54 to the on position and pressing start switch 55. The activation of the engine causes air pump 37 to start delivering air under pressure through pipe 45 to the top of hopper 19. Only a short time is required for the pressure inside hopper 19 to reach the relatively low operating pressure of about 3 psi.

Next, the operator unrolls supply hose 31 from the bed of delivery vehicle 12 and connects an end of the hose to the external house coupling 64 by removing plug 69 of house coupling 65 and threadably inserting threaded delivery coupling 71. Delivery hose coupling 63 is then placed over threaded coupling 71 and wings 63*a*, 63*b* are moved to the clamping position.

The operator then returns to biomass fuel delivery apparatus 11, and pushes handle 33 to open gate valve 30 (see FIG. 6C). Air pump 37 continues to run at this time and produces pulses of air under pressure. Biomass fuel pellets flow out of hopper 19 through the gate valve into delivery hose 31 under the force of gravity. The biomass fuel pellets are driven through delivery hose 31 under the pressure generated by air pump 37. The biomass fuel pellets flow through coupling 64, pipes 75 and 74 and then into the biomass fuel bin 72 within the structure.

Since biomass fuel pellets can accumulate dust during transportation due to abrasion between the pellets, filter cover 73 is used to contain the dust while the pellets are delivered to bin 72, while still allowing air displaced by the fuel to escape. Normally, filter cover 73 remains in the position shown in FIG. 9, and there is generally no need to remove it.

The biomass fuel delivery continues with the operator at the site of apparatus 11 in close proximity to handle 33. When the level of biomass fuel inside of fuel bin 72 is full, the operator pulls handle 33 to close the hopper gate valve 30, stopping the delivery of biomass fuel to bin 72. Although the gate valve is closed, air under pressure continues to pass through it, and engine 36 is permitted to run until all of the biomass fuel in hose 31 is fully discharged. Engine 36 is then stopped by turning switch 55 to the off position. The operator then removes delivery hose coupling 63 from the external house coupling 65. Delivery hose 31 is recoiled into the bed of delivery vehicle 12, and the operator then drives to the next delivery location. Alternatively, there may be an automatic shut off for the compressor. For example, this could be activated when an increase in pressure in the air hose is sensed, which would indicate that the fuel chamber has been filled.

The present invention allows the biomass fuel delivery process to be completed quickly and efficiently, and has the additional advantage of allowing the delivery to take place without the operator entering the residence or other structure. Rather, the operator merely moves between the delivery vehicle and external hose coupling, and does not have to unload and carry several heavy biomass fuel bags from the delivery vehicle into the residence or business, or to open the bags of and lift and empty them into the biomass fuel bin. The present apparatus and system also eliminates the difficulties associated with loading, transporting, unloading, carrying and emptying biomass fuel bags.

While a detailed description has been provided for this invention, the present invention is not limited thereto, and modifications to the disclosed embodiments will be apparent. The invention is defined by the claims that follow.

What is claimed is:

1. A method of filling a biomass fuel bin and collecting ash from combustion of biomass fuel, comprising:

coupling a biomass delivery hose to an opening in a bin and delivering biomass fuel to the bin;

setting an end of the biomass fuel delivery hose of a biomass fuel delivery vehicle to communicate with an opening in a chamber containing ash, wherein a second end of the hose communicates with a container on the biomass fuel delivery vehicle for collecting ash; and applying a vacuum to the delivery hose, whereby ash is carried to the container.

2. The method of claim 1, wherein a piping element is present between the delivery hose and container for ash, and the piping element is in communication with a hopper for delivering biomass fuel.

3. A method of remotely filling a biomass fuel chamber located within a structure having an external wall, an opening in the wall sized to receive a biomass delivery pipe, and a conduit between the wall and the fuel chamber located on an internal side of the wall, the method comprising:

transporting a sealed hopper containing biomass fuel to a point proximate the structure;

connecting the end coupling of a biomass fuel delivery hose to the wall opening, wherein a second end of the hose connects to an outlet of the hopper;

pressurizing the hopper;

opening a gate located at an outlet of the hopper so that biomass fuel enters the delivery hose from the interior of the hopper;

generating a signal when the level of biomass fuel in the biomass fuel chamber reaches a satisfactory level;

closing the gate when the signal is generated; and removing the end coupling from the wall opening.

4. The method of claim 3, additionally comprising the step of generating a signal when the level of biomass fuel in the fuel chamber reaches a satisfactory level.

5. The method of claim 3, wherein the gate is closed when the level of biomass fuel in the fuel chamber reaches a satisfactory level.

6. The method of claim 3, additionally comprising the step of operating an air pump before opening the gate valve, wherein the air pump is connected to the hopper.

7. The method of claim 3, additionally comprising the step of maintaining the pressure of the hopper at about 3–7 psi.

8. The method of claim 3, further comprising collecting ash from combustion of biomass fuel through the delivery hose.

* * * * *